US006089768A

United States Patent [19]

Barrus et al.

[11] Patent Number: 6,089,768

[45] Date of Patent: Jul. 18, 2000

[54] PRINT RIBBON FEEDER AND DETECTION SYSTEM

[75] Inventors: Gordon B. Barrus, San Juan Capistrano; Greg J. Anderson, Long Beach, both of Calif.

[73] Assignee: Printronix, Inc., Irvine, Calif.

[21] Appl. No.: 09/072,601

[22] Filed: May 5, 1998

[51] Int. Cl.[7] ..... B41J 31/10

[52] U.S. Cl. ..... 400/238; 400/239; 400/244

[58] Field of Search ..... 400/242, 244, 400/238, 239, 225

[56] References Cited

U.S. PATENT DOCUMENTS

| | | | |
|---|---|---|---|
| 455,263 | 6/1891 | Rogers . | |
| 472,847 | 4/1892 | Bailey . | |
| 1,581,040 | 4/1926 | Vannote . | |
| 2,020,152 | 11/1935 | Mannino . | |
| 3,554,349 | 1/1971 | Hebert . | |
| 3,825,103 | 7/1974 | Riley . | |
| 4,177,731 | 12/1979 | Kleist et al. . | |
| 4,338,645 | 7/1982 | Mohri et al. . | |
| 4,475,830 | 10/1984 | Schaefer | 400/238 |
| 4,479,730 | 10/1984 | Yoshioka et al. | 400/249 |
| 4,496,117 | 1/1985 | Kashiwagi et al. . | |
| 4,969,761 | 11/1990 | Gibson-Saxty . | |
| 5,143,461 | 9/1992 | Inoue et al. . | |
| 5,323,286 | 6/1994 | Faul . | |
| 5,333,960 | 8/1994 | Nam . | |
| 5,366,303 | 11/1994 | Barrus et al. . | |
| 5,497,183 | 3/1996 | Yoshida et al. . | |
| 5,560,722 | 10/1996 | Kawaguchi | 400/238 |
| 5,605,405 | 2/1997 | Kurz . | |

*Primary Examiner*—John S. Hilten
*Assistant Examiner*—Darius N. Cone
*Attorney, Agent, or Firm*—George F. Bethel

[57] ABSTRACT

A clean print ribbon feed system and method for a printer having a ribbon with two non-inked clean hands portions wound around a pair of spools is disclosed. Detection of the spool having greater angular velocity and lesser angular velocity determines the direction of feed. The spool having greater angular velocity winds and takes up the print ribbon. The non-inked portion can be formed as a conductive plastic and is initially wound on each spool. Detection of the non-inked portion of the ribbon takes place by two electrical contactors. The determination of the angular velocity of the spools determines the amount of print ribbon on one of the spools so that the spool having the lesser ribbon can be driven as a take-up spool to provide proper directional drive for winding the clean hands portion and the inked portion which follows.

27 Claims, 5 Drawing Sheets

PRINT RIBBON FEEDER AND DETECTION SYSTEM

FIELD OF THE INVENTION

The field of this invention pertains to printers and particularly those printers that have ribbons that are impacted for printing on paper or other media. In such printers, it is known to drive a ribbon from two spools. Generally, one end of the ribbon is connected to a spool driven by a motor in a winding or take-up mode. The other portion of the ribbon is connected to a spool in a feed mode. This invention particularly relates to emplacing the ribbon with a clean non-inked leader or portion and then appropriately driving it.

BACKGROUND OF THE INVENTION

This invention is particularly adapted to ribbon drives for impact printers. Such impact printers can be dot matrix printers and more specifically line type printers. Such line printers are known in the art and have been developed extensively by the assignee of this invention.

The inked ribbons of such various printers are repeatedly impacted against a length of print paper or other printable medium by certain impact elements. The impact elements can each define a shape or a character or simply print dots, with characters or other indicia to be printed being formed in a dot matrix fashion.

Such dot matrix printers can be of the line printer type in which a plurality of hammers or other impact printing mechanisms are mounted along the length of a hammerbank. They are driven by a shuttle assembly and are selectively actuated to impact the print paper. The impact is through a length of inked ribbon. This prints dots on the paper as the shuttle assembly is caused to undergo reciprocating motion relative to the paper.

The inked ribbon extends through the print station and has the opposite ends thereof wound upon an opposite pair of spools. During printing, the opposite spools of the ribbon drive are rotatably driven to provide continuous motion of the length of ribbon through the print station. When the end of the ribbon is reached the direction of drive of the spools is reversed. This causes the ribbon to move through the print station in the opposite direction.

A pair of two phase stepper motors control the tension and the velocity of the print ribbon between two spools. At any given time during printing, one motor pulls ribbon through the print station at a substantial constant velocity while the second motor is run in a regenerative mode to provide tension. When the ribbon reaches the end of it's travel in any given direction, it's direction is reversed so that the function of the two respective motors and spools are then reversed.

The angular velocity of the feed motor or motor attached to the spool from which the ribbon is unwinding, is calculated by counting the number of zero crossings on the back EMF waveform. In any given period of time the angular velocity of the take-up motor is set by the system micro controller. The ratio of the angular velocities of the feed take-up spool or reel is a unique number over the range of ribbon radii in the system. The radius of the ribbon material on each reel can be determined at set intervals based upon the ratio of the angular velocities. This ratio information used to determine the angular velocity and tension is updated at any given time.

A major problem with regard to loading the inked ribbon into a printer is the fact that the ribbon itself has ink which can be imparted to any surface which it touches. This is particularly true with regard to a user's hands. When handling the ribbon, users often times find their hands very dirty as well as various portions of the equipment.

In the past, it has been a significant problem to load an inked ribbon without getting dirty. When loading the ribbon, it is also necessary to determine where the actual clean portion and the inked portion is.

In the past, there have been attempts to provide clean ribbons by having non-inked strips of various material. However, there has been no ability to effect the loading of the strip and have a fail safe means of recognizing the position of where the clean strip is in comparison to the inked ribbon.

The invention hereof provides for a printer ribbon having a clean hands portion formed of an electrically conductive plastic or other material that can be monitored with respect to the interface at which it is connected to the inked portion of the ribbon. This allows a user and installer of the ribbon to emplace the ribbon by merely handling the non-inked portions and emplacing it over the spools or spindles which are driven by the motors. Thereafter, the system of this invention detects where the non-inked portion is and determines at a particular juncture or interface of the non-inked portion and the inked portion when and where printing can begin.

The foregoing is effectuated through the circuitry of this invention and in particular the detection of the respective angular velocity of one spool compared to the other.

An object of this invention is to permit the loading of an inked ribbon into a printer without smudging or soiling a user or the surrounding area in which the ribbon is loaded.

Another object of this invention is to allow for a clean type of ribbon leader to be emplaced in a printer on a relatively automated basis.

A further object of this invention is to allow a print ribbon to be emplaced within a printer and not create a soiling condition for an operator while at the same time allowing an operator to avoid having to handle the ribbon after it has been emplaced for positioning with respect to the printing functions.

Another object of this invention is to automatically detect a position of a clean ribbon leader with respect to the inked print ribbon so that printing can commence with respect to the inked ribbon portions on an automated basis.

An important final object of this invention is to allow a print ribbon to be emplaced in a printer with clean leaders extending therefrom and a detection of the position of the clean leaders to effect automated startup of printing functions after emplacement of the ribbon in the printer.

SUMMARY OF THE INVENTION

In summation, this invention is a system and apparatus for emplacing a print ribbon in a printer having two spools which drive the ribbon in each direction wherein the print ribbon has a non-inked portion that can be handled by a user and emplaced in the printer and loaded without soiling and thereafter allowing the printer to automatically determine the position of the print ribbon with respect to the non-inked portion.

More specifically, the invention comprises a printer having two spools or spindles each driven by motors. The ribbon emplaced in the printer has a conductive plastic material portion at either end wound around a spool sufficiently to avoid soiling contact with a user's hand upon loading, or the surrounding area. The conductive plastic is particularly utilized for emplacement without soil while at the same time providing conductivity over a pair of sensing bars or posts to determine ribbon position.

After emplacement the ribbon is then tensioned and driven sufficiently to provide for orientation of the inked portion with respect to the non-inked conductive plastic portion.

The relative position of the ribbon as to a substantially full spool or a comparatively empty spool is then determined by driving the motors to determine the angular velocity of the spools. The angular velocity of the smaller spool or that which is not substantially wound with ribbon is greater than that of the fully wound spool. This then allows the processor of the invention to determine the particular spool which has the larger and smaller of the two respective amounts of ribbon.

The inked ribbon is then driven in the proper direction to cause it to be wound onto the spool having the lesser print ribbon while being dragged from the spool having the greater amount of print ribbon.

Consequently, this invention allows for emplacement of the ribbon without further action and while at the same time automatically providing for orientation and driving of the ribbon in the right direction from the substantially full spool to the take-up spool.

DESCRIPTION OF THE PREFERRED EMBODIMENTS

Figure 1:
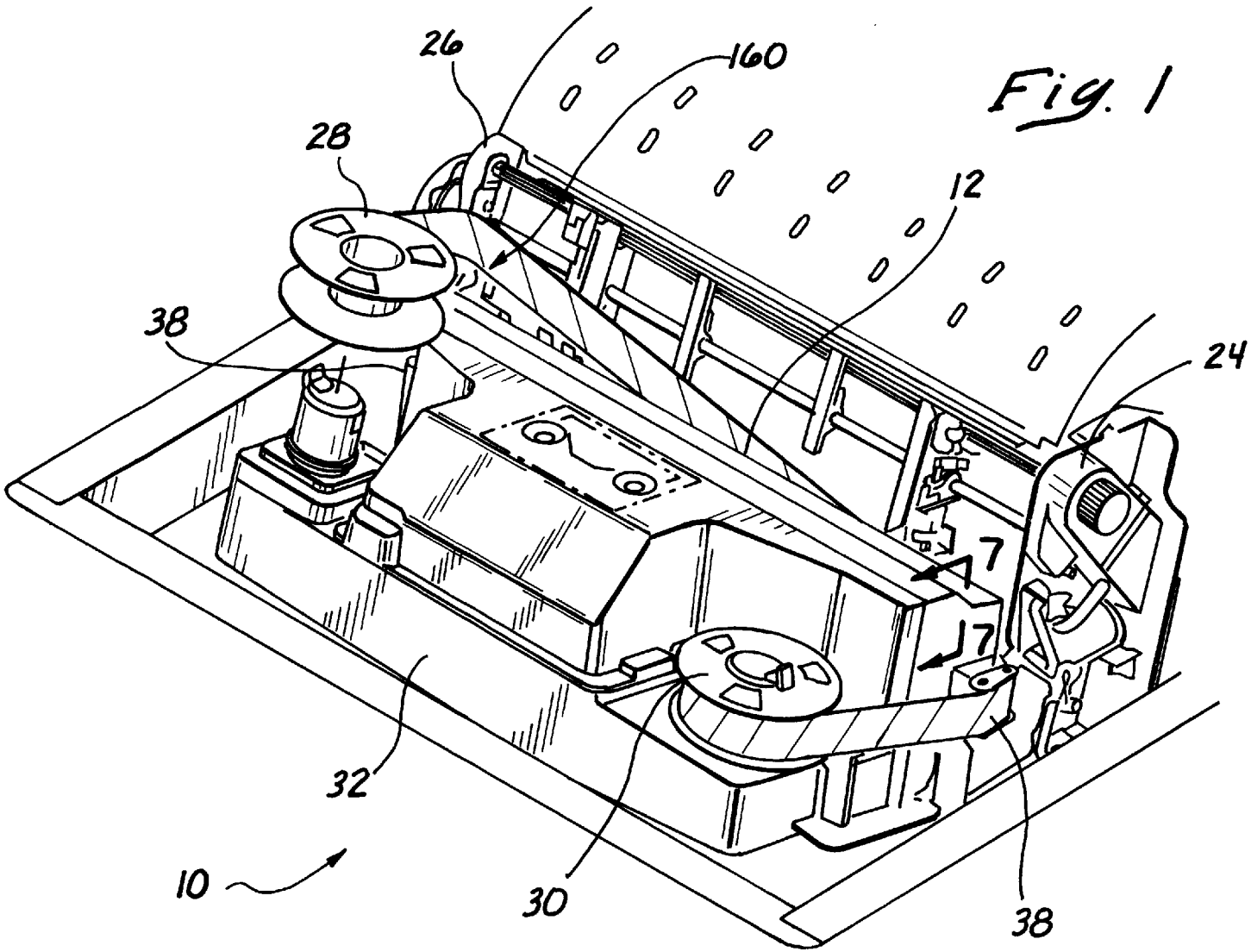
FIG. 1 shows a perspective view of a print ribbon of this invention being loaded into a printer.

FIG. 1 shows a printer 10 of the type known as a dot matrix line printer. A ribbon is shown being emplaced in the printer attached to two spools which will be detailed hereinafter.

Figure 7:
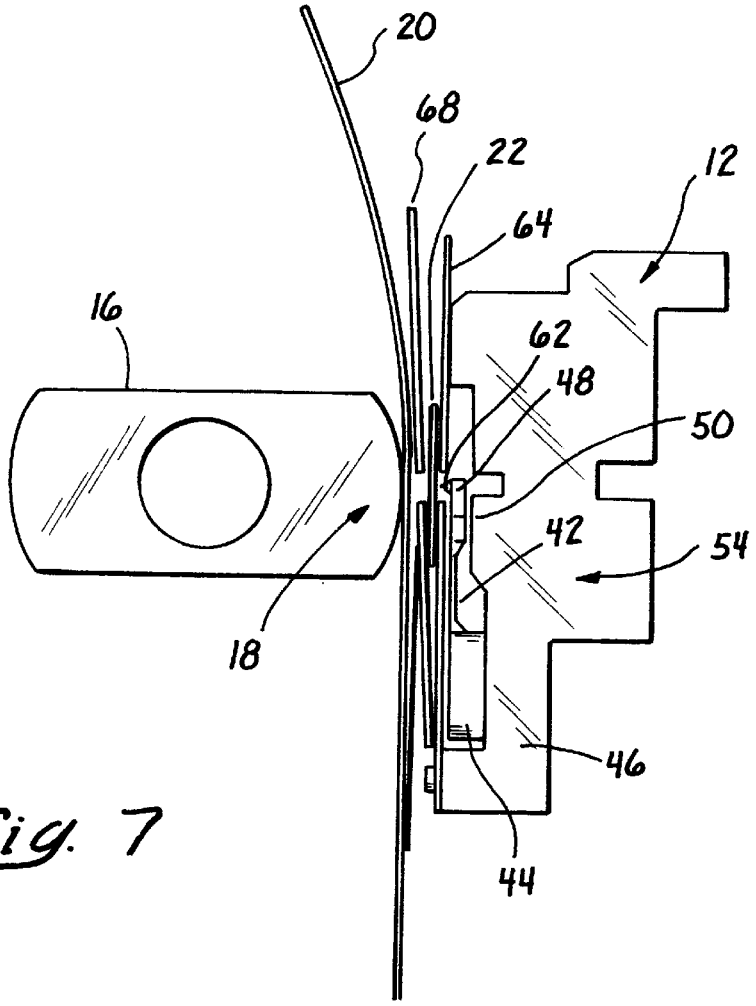
FIG. 7 shows a detailed sectional view of the print ribbon passing through the print station with the hammerbanks and platen in associated relationship therewith as sectioned along lines 7—7 of FIGS. 1 and 2.

The printer includes an elongated hammerbank 12 hidden from view. The hammerbank 12 is mounted and driven in a reciprocating manner by a shuttle drive. The hammerbank reciprocates with respect to a platen 16 as seen in FIG. 7 sectioned from lines 7—7 of FIGS. 1 and 2. The space between the hammerbank 12 and the platen 16 defines a print station 18. This is more easily seen in FIG. 7.

Looking more particularly at FIG. 7, it can be seen that within the print station 18 is a length of print paper 20 and a print ribbon 22.

The print paper 20 is advanced upwardly through the print station 18 by two tractor drives 24 and 26 on opposite sides of the printer. The tractor drives 24 and 26 move the paper 20 upwardly as each row of dots is printed thereacross.

The ribbon 22 extends along the length of the print station 18 and has the opposite ends thereof wound on two opposite pairs of reels or spools 28 and 30. Spools 28 and 30 are connected to the ribbon drive 32 at the lower end of the printer 10.

Figure 2:
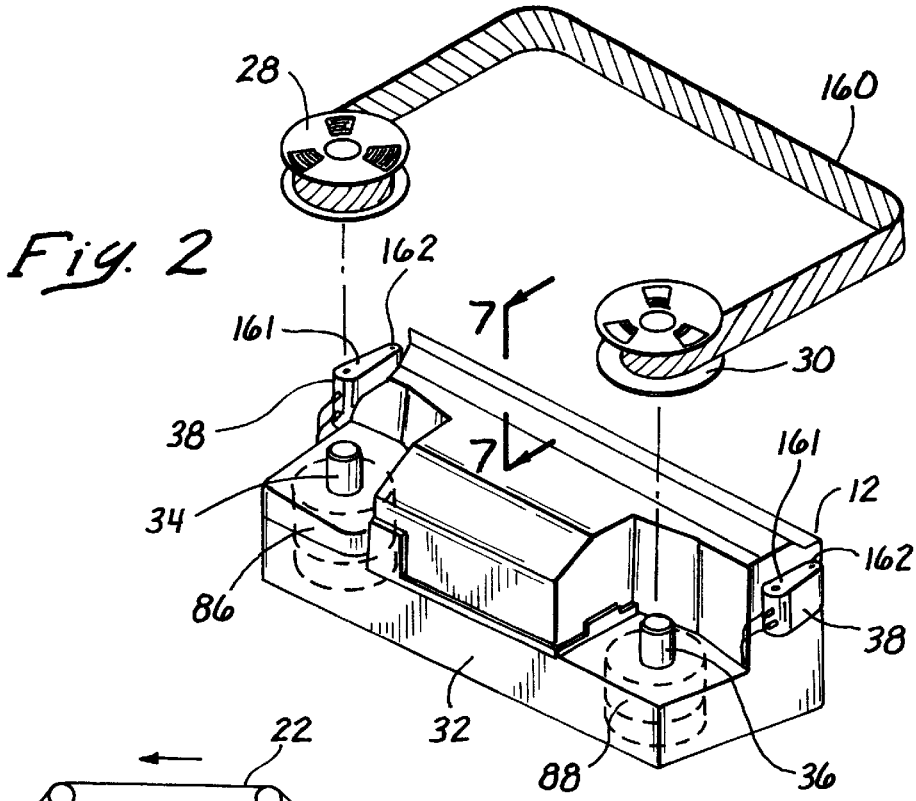
FIG. 2 shows the print ribbon of this invention with the conductive clean portion of the print ribbon exposed as it is being emplaced in the printer.
Figure 6:
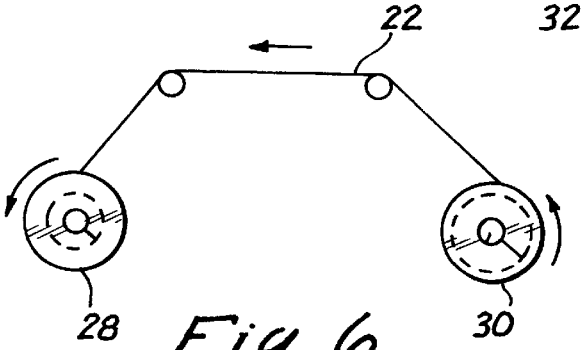
FIG. 6 shows a view of the print ribbon being driven on the respective spools.
Figure 4:
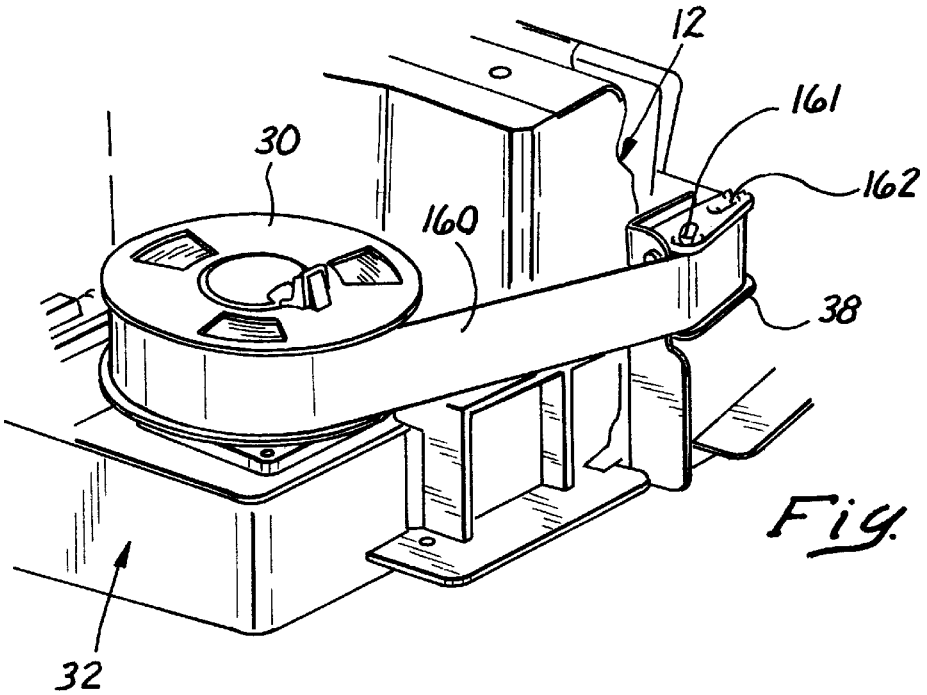
FIG. 4 shows a detailed perspective view of the ribbon on a spool viewed from the right hand side of FIG. 1.

The ribbon drive 32 is shown in an exploded form in FIG. 2. The opposite spools 28 and 30 are removably mounted on spindles 34 and 36. Spindles 34 and 36 are connected to the stepper motors which shall be detailed hereinafter as to the motors and the control system. In order to properly dispose the ribbon 22 within the print station 18 it is facilitated by a pair of guides mounted on opposite ends, one of which is shown as guide 38 in FIGS. 1, 2, and 4. The other guide which is a mirror image of guide 38 is hidden from view in part.

When the printer 10 is printing, the ribbon 22 is driven by the stepper motors turning the spindles 34 and 36. The speed of the print ribbon 22 can vary depending upon the type of printing conditions required. Generally, the print ribbon 22 is advanced in one direction such as from the spool 30 to the spool 28 and then reversed thereafter.

The hammerbank 12 seen in FIG. 7 extends from the opposite ends to a mount for the hammerbank 12 to provide reciprocating motion. A plurality of resiliently flexible hammer springs 42 are shown.

The hammer springs 42 are mounted along a length of the hammerbank 12 such that a lower end 44 of each spring 42 is secured to a base 46. An opposite upper end 48 of each hammer spring 42 is free to move with the flexure of the spring 42.

Normally, the springs 42 are magnetically held in a retracted position against pole pieces 50 mounted within a frame 54 of the hammerbank 12. A pair of coils are mounted on the pole pieces 50. Between the pole pieces 50, a permanent magnet is disposed between them and within the frame 54.

The upper end 48 of the hammer spring 42 is normally held in a retracted position against the pole pieces 50 by the permanent magnet forming a magnetic circuit therewith. When the coils are momentarily energized, it overcomes the magnetic force and releases the hammer spring 42 from its retracted position causing dots to be printed on the paper 20 by a dot printing impact tip 62. Afterwards, the spring 42 rebounds into the retracted position against the pole pieces 50.

A thin planar hammerbank cover 64 is mounted on the base 46 of the hammerbank. A thin planar paper ironer 68 of resilient material is disposed between the paper 20 and the hammerbank cover 64. This resiliently bears against the paper 20 to create a drag and hold the paper under tension as it is advanced upwardly by the opposing tractor drives 24 and 26.

In order to drive the spools 28 and 30, two stepper motors 86 and 88 are shown connected to the spindles 34 and 36. The stepper motors 86 and 88 are connected to the controller circuitry of the invention as shown generally by the lead lines 90 and 92. Lines 90 and 92 are deemed to be for descriptive purposes only inasmuch as the respective stepper motors comprise a first and second series of poles for two phase operation. The first and second series of poles can be in any multiple even series such as 8 or 16. They are connected to the respective lines shown hereinafter with respect to their connection to full H bridge drivers. In this case, lines 77 and 79 connect a first phase for motor 86, while lines 81 and 83 connect a second phase. Lines 85 and 87 connect a first phase for motor 88, while lines 89 and 91 connect a second phase. The two phase stepper motors are connected to the two ribbon spools 28 and 30 by spindles 34 and 36.

At any given time during normal printing one of the two motors 86 or 88 provides the drive torque or take-up to pull the ribbon 22 through the print station 18. While this is happening the other motor provides the required tension to the feed spool to maintain proper ribbon tracking through its drag action. When the end of the ribbon 22 is reached the functions of the two respective motors 86 and 88 are reversed.

Figure 5:
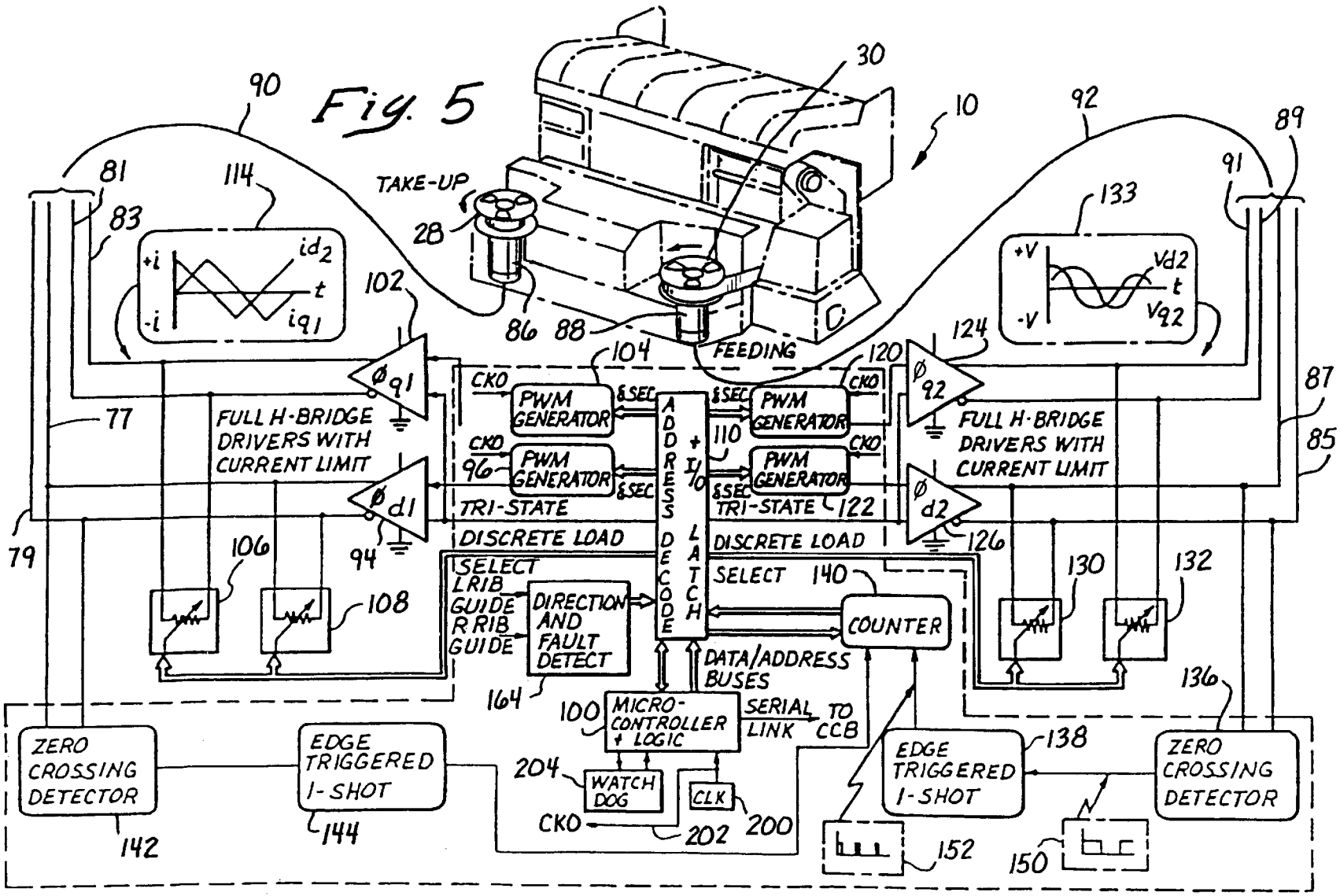
FIG. 5 shows a schematic view of the circuitry and logic of this invention with respect to the printer.

In the schematic description shown in FIG. 5, motor 86 is providing the drive torque to take-up and pull the ribbon 22 across the print station 18. One phase of the motor 86 is driven through lines 77 and 79 by a full H bridge 94 connected to a pulse width modulator (pwm) generator 96. The duty cycle of the pulse width modulator generator 96 is determined by a digital number loaded into the latch 98 by the system micro controller 100. The pwm generator 96 can be substituted with any type of linear amplifier. Also, analog or digital control functions can serve to regulate the drivers.

In like manner, the other phase referred to as a quadrature phase is driven through lines 81 and 83 by another full H bridge 102 connected to another pwm generator 104 or in the alternative, a linear amplifier. The duty cycle thereof is also determined by the system micro controller 100.

The foregoing provides for a voltage mode pwm drive. During this driving mode load resistor banks 106 and 108 are held in a tri-state mode by the system micro controller 100 via the address decode input output latch 110. This effectively disconnects the resistor banks 106 and 108 from the output circuit of the full H bridges 102 and 94, or in the alternative variable resistance amplifiers substituted for the resistor banks.

The reason why the resistors 106 and 108 are disconnected is to prevent any load being applied to the drive motor amplifier. The load when applied is for creating a drag as will be seen in the drag relationship of the motor 88 in its re-generative mode. The other resistor bank is symmetrical in function to the resistors 106 and 108.

In lieu of a variable resistor bank, a load bank or variable impedance amplifier can be used. Also a highly advantageous method is to short the motor coils for variable durations to create a load or resistance. In many cases this is preferable to a separate and independent load resistor bank.

The micro controller 100 updates the duty cycle of the pwm generators 96 and 104 in a manner that the vector sum of the torques of the two phases created by the resultant current profiles is a constant. This-provides a constant torque drive. As the ribbon 22 on the take-up spool 28 accumulates, the micro controller 100 logic reduces the angular velocity of the motor 86 to maintain a constant linear velocity of the ribbon 22 across the print station 18. This is through the update provided by pulse width modulation generators 120 and 122 or linear amplifiers at the appropriate times in a manner to be described hereinafter through the zero crossing and edge triggered circuitry connected to the motor 88 in the re-generative mode serving as a drag motor. Here again the pulse width modulator generators 120 and 122 can be substituted by any suitable type of linear amplifier.

As the angular velocity of the take-up or winding motor 86 is reduced, the micro controller 100 logic updates the pwm generators 96 and 104 in a manner that maintains a constant peak current which is established through the H bridges 94 and 102 in the 90 degree phased manner shown in block 114.

A retarding torque is provided in the given mode shown by motor 88 when the ribbon 22 is unwinding, and when motor 86 is providing take-up or winding torque. In the regenerative mode of operation, the full H bridges 124 and 126 are held in a tri-state mode by the micro controller 100 logic through the address decode of input output latch 110. The result is to effectively disconnect bridges 124 and 126 from the motor 88. During this mode of operation the load banks or resistors 130 and 132 are connected to the windings of motor 88.

The back emf voltage across the two phases of motor 88 can be seen in the lag of the voltages in a 90 degree manner shown in block 133. These back emf voltages are applied to the respective load banks provided by resistors 130 and 132.

Here again as an alternative to the variable resistor banks 130 and 132, a variable impedance amplifier can be substituted for each variable resistor, or load bank as the case may be. Also the motor windings can be shorted for variable durations to provide a resistance through the windings to increase or decrease drag.

As the feed reel or spool 300 empties, its angular velocity increases. The effective lever arm for the distance from the center of the shaft of the motor 88 to the edge of the ribbon material 22 on the spool 30 decreases. Based thereon the controller 100 reduces the load on the resistance bank which is comprised of resistors 130 and 132 connected to the two phases of motor 88 or the controller varies the shorting of the motor coils to provide the appropriate loading for drag.

A zero detection circuit 136 is connected across one winding of the motor 88. This creates a pulse width duration corresponding to the positive half cycle of the back electromotive force (BEMF) of the motor 88 while operating in the regenerative mode. This signal is fed into the edge triggered one-shot 138 which creates a pulse for each edge of the half cycle pulse. The signal can be seen in the box 150 provided by the zero crossing detector as it feeds into the edge triggered one-shot 138 providing a one-shot output shown in box 152. The output of the edge triggered one-shot 138 as shown by the waveform in box 152 is then counted by a counter 140.

Since the motor 86 is providing a drive or take-up torque, the signals from its corresponding zero crossing detector 142 and a one-shot 144 are ignored by the counter 140. The angular velocity of the drive motor 86 is determined by the controller 100 which is provided with the equivalent electrical zero crossing counts of the motor 88.

When given the range of the ribbon 22 radii on the respective reels 28 and 30, the ratio of the counts of the zero crossings is a unique number from which the radii of the ribbon 22 material on each reel can be calculated. The controller 100 periodically checks and resets the counter 140. The resulting ratio information is used to alter the drive frequency of the motor 86 to maintain constant linear print ribbon velocity across the print station 18 as well as to alter the loading on motor 88 to maintain proper ribbon tension.

At the end of the travel of the ribbon 22, when the feed reel 30 is nearly empty, an elongated conductive plastic strip 160 attached to the ribbon 22 passes over the ribbon guide 38. This can be exemplified more clearly in FIGS. 2, 3 and 4 wherein the conductive strip 160 is shown across the ribbon guide 28. The elongated conductive plastic strip is approximately 5 to 10 feet long and serves the function of a clean ribbon portion or ribbon without ink. When initially wound around each spool 28 and 30 upon loading it avoids soiling the operator's hands. At this point, a reversal is signaled. This is caused by the conductive strip 160 shorting two bars 161 and 162 connected to a detection circuit shown as circuit 164.

At this point, the full H bridges 102 and 94 as well as the load banks 130 and 132 are inactivated. The signals from the respective edge triggered one-shot and the zero crossing detector are ignored. The signals from the zero crossing detector 142 and the edge triggered one-shot 144 are then processed. The load banks 106 and 108 as well as the full H bridge drivers 124 and 126 in their alternative mode are activated after an appropriate time delay.

The time delay is established within the micro controller 100 logic to allow a ringing out or settling of the electronics. At such time, the respective take-up and feed motors 86 and 38 apply a degree of tension on the print ribbon 22 to tension it sufficiently across the print station 18.

The spool or reel 28 then becomes the feed spool with motor 86 operating in the regenerative mode. Spool or reel 30 then becomes the take-up spool or reel with motor 88 operating in the drive or take-up mode until the opposite reversal or elongated clean ribbon strip 160 is sensed by the ribbon guide in connection with the left side of the printer.

For purposes of understanding, it should be understood that a clock 200 is provided to the circuit. The clock 200 goes into a clock output (cko) line 202. A watch dog circuit 204 is provided which shuts down the entire printer when a failure mode is detected through the micro controller 100 logic.

The two phased stepper motors 86 and 88 are driven by the pulse width modulated sine waves generated by a micro controller which is the micro controller 100 in conjunction with the custom mechanical driver or ASIC.

Figure 3:
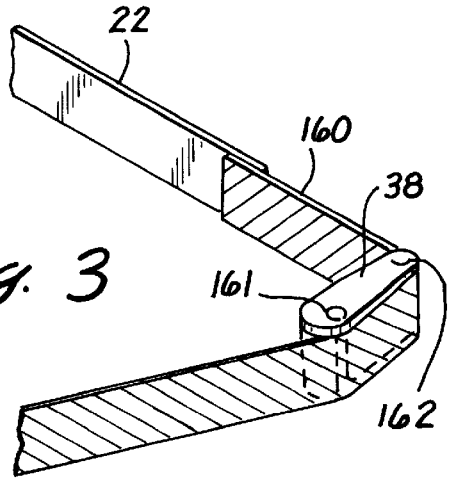
FIG. 3 shows the conductive clean portion of the print ribbon attached to the inked portion as it passes over a detector.

Looking more specifically at the print ribbon that is the inked portion namely inked portion 22 as connected to the conductive plastic portion 160 it can be seen in FIG. 3 that they are joined. The joining can be in any particular manner with a bonding adhesive or weldment. In the alternative gluing a strip on either side in order to hold them together at their abutting interface can be utilized. The electrically conductive plastic of the ribbon 160 can be of any type of conductive plastic or other material which is known in the art including Mylar and other plastics having certain conductivity that can be imparted thereto. This electrical conductivity allows for the functions that will be detailed hereinafter.

This electrically conductive Mylar portion of the print ribbon or the metalized portion is shown as portion 160 in FIG. 2 and can be seen as wrapped around the spools at the point of installation. At the point of installation as shown in FIG. 1, the Mylar print ribbon portion 160 is also shown as the only exposed portion of the print ribbon. The entire print ribbon as exposed is only formed of the electrically conductive Mylar ribbon portion 160. This provides the clean portion to avoid soiling the installer's hands or surrounding area.

As seen from the showings, of the figures, the ribbon when being loaded is exposed as only the Mylar ribbon or tape portion 160 which shall be called the clean ribbon segment or clean hands portion. The clean ribbon segment hereinafter shall refer to that portion of the conductive plastic or any other leader material which does not have printing ink thereon. This portion of the ribbon is wound around the relatively empty take-up spool and the other spool so that only the clean ribbon or clean hands portion 160 is exposed. Thus, when one handles the ribbon such as shown in FIGS. 1 and 2 for loading purposes, one's hands only contact the clean ribbon portion 160. Further to this extent, the surrounding area is not soiled with printing ink.

Once the spools 28 and 30 are loaded in the printer 10, a determination must be made of the relative position of whichever spool is in effect empty and only has the leader or clean ribbon portion exposed which is the take-up spool. The other spool is fully wound with the clean ribbon portion and the underlying printing ribbon and must be established as being the feed spool. Spools 28 or 30 can be interchanged from the left or the right side and then a determination as to feed spool or take-up spool made in the following manner by the system of this invention. The way this is effected is seen in the logic diagram of FIG. 8 in conjunction with the remaining figures, and in particular FIG. 5.

FIG. 5 shows the controlling and drive functions of the printer 10. These are fundamentally part of an engine controller (EC) which establishes the overall control functions. The data controller (DC) is also mounted on a controller board on which the engine controller (EC) is mounted. A host as in all cases, drives the controller board that includes the engine controller (EC) and the data controller (DC).

The engine controller (EC) will test for a clean hands ribbon during power up or whenever a fault is cleared. This is detailed hereinafter by the logic diagram of FIG. 8. When a clear fault command is sent from the data controller (DC) to the engine controller (EC), the following steps are undertaken in order to ascertain the orientation of the print ribbon and spools having been installed as well as the fact that they have been installed. It should be born in mind that this system will allow for both totally inked ribbons as well as ribbons with the clean ribbon leaders or clean hands portion 160 connected thereto.

After installation, the engine controller (EC) will wait a period of two seconds. This period allows the user enough time to move his or her hands off of a platen lever namely the lever which is connected to platen 16. The engine controller (EC) will then open the platen 16. Thereafter, the engine controller (EC) will provide tension to the print ribbon by driving both spools 28 and 30 in their normally driven position for a half a second. When the ribbon is driven and put in tension and pulled in opposite directions for a half a second, it places it into a proper orientation with respect to the ribbon guides 38.

The engine controller (EC) will then check the two shorting bars 161 and 162 of each guide 38 (left and right) which can be referred to as ribbon posts. In effect, by checking the two ribbon posts 161 and 162 of each guide 38, a determination is made as to whether or not ribbon posts 161 and 162 have been shorted by the conductive metallic ribbon 160 passing thereover and being in contact therewith. This shorting of the ribbon posts 161 and 162 causes a determination to be made that in point there is a metallic bridge or conductive tape portion 160 thereacross. In order to provide surety, the ribbon posts 161 and 162 are checked a total of three times because of possible discrepancies in contact which might have occurred.

If either one of the pairs of ribbon posts 161 and 162 of each guide 38 is inactive, namely that on the right side or on the left side, the engine controller (EC) will assume that a clean hands ribbon has not been installed. In effect, the electrical continuity of the metallic ribbon or clean print ribbon segment or leader 160 as seen in FIG. 2 would not be exposed to cause either the left hand ribbon guide 38 or the right hand ribbon guide 38 and their respective ribbon posts 161 and 162 to be bridged. This discloses the fact that the ribbon posts 161 and 162 on the left and the right hand side of the printer are inactive. Thus, an assumption is made that a clean hands ribbon has not been installed. The engine controller (EC) will then close the platen 160. Once the platen 160 closes the ribbon installation is complete even though in this case, the clean hands ribbon portion 160 has not been installed. This is shown by the statement in FIG. 8 wherein no clean hands ribbon has been established which closes the platen and allows continuity of printing functions.

Figure 8:
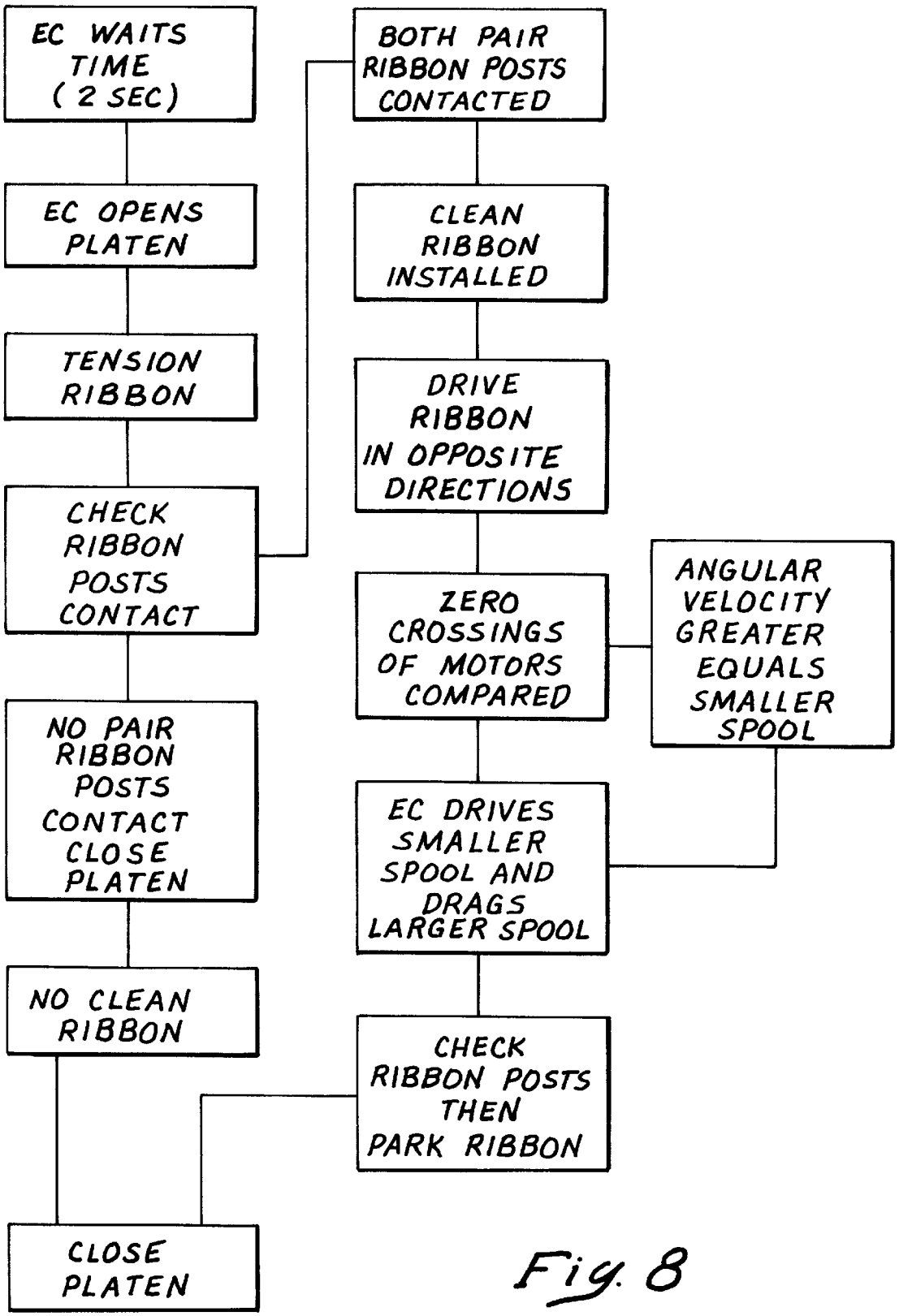
FIG. 8 shows a block diagram of the respective logic of the sensing functions of the system with respect to the positioning of the print ribbon.

If in the alternative, a check of the ribbon posts causes contact at ribbon posts 161 and 162 on both sides of the printer namely that on the right and the left side, the engine controller (EC) will assume that a clean hands ribbon has been installed. The engine controller (EC) will then continue with the installation test as seen in FIG. 8 indicating that a clean hands ribbon with the conductive portion 160 has been installed after the check of the ribbon posts and their contact, namely ribbon posts 161 and 162.

The engine controller (EC) will then drive the ribbon in one direction for approximately one second. Thereafter, it will drive the ribbon in the other direction for approximately one second. The zero drag crossings of the zero crossing detector 136 in the two directions will be compared within the micro controller 100 logic. A comparison is made of the respective spools 28 or 30. The spool having the least amount of ribbon whether it be inked print ribbon 22 or the clean hands ribbon 160 will be moving at the higher of the two angular velocities. The one with the greater amount of print ribbon 160 or 22 thereon will be moving at a slower angular velocity. This determines that the one with the less print ribbon (i.e. the one of higher angular velocity movement) should be the take-up spool, while the other one should be the feed spool.

The engine controller will then drive the smaller spool and drag the larger spool. No speed adjustment updates are processed as during normal printing during this special drive sequence. Throughout the drive sequence since the angular speed is not precisely known, zero drag will be applied to the dragging or feed spool.

While the engine controller (EC) is driving the print ribbon 160 and 22, it will check the ribbon turnaround posts namely 161 and 162 on either side every two hundred and fifty milliseconds. When the engine controller (EC) determines during any one of these two hundred and fifty millisecond polling periods that both ribbon turnaround posts 161 and 162 are inactive, it shows that the metallic clean ribbon portion 160 has passed. At such time all that is being passed over the ribbon posts 161 and 162 is non-conductive inked ribbon 22. The engine controller (EC) will then park the ribbon a half a second thereafter to insure that the metallic strip 160 has completely cleared both pairs of ribbon posts 161 and 162. This will then signal printing can begin. The platen 16 will then close and printing can begin.

As an alternative to the sensors and guide 38 with the detectors 161 and 162, clean hands ribbon portion 160 can be detected by other means. For instance guides 38 and detectors 161 and 162 can be substituted with optical sensors to determine the relative opacity, reflectivity or other variations between the inked ribbon portion 22 and the clean hands portion 160. Also, optical ports or openings in the clean hands ribbon portion 160 can be provided so that a beam of light can be read when this portion passes an optical sensor or reader.

From the foregoing, it can be seen that this invention is a substantial step in the art of clean ribbon emplacement. This invention then provides a systematic approach of determining the particular spool that should be driven without operator intervention, all of which should be broadly recognized under the following claims.

What is claimed is:

1. A clean print ribbon feed system for a printer having a platen on which paper can be impacted by a striking means at a print station and said ribbon is driven between the striking means and the paper comprising:

a ribbon having two non-inked clean hands portions, each having at least a portion thereof formed of an electrically conductive material and wound around one of two spools connected to an inked portion to allow said ribbon to unwind from one spool and be fed and wound on the other of said spools and alternatively said spools can provide for reversed operational functions;

motor means connected to each of said spools for rotationally driving said spools wherein one is a take-up motor and the other is a feed motor to provide drag and can alternatively provide the reversed functions;

controller means for controlling the two respective motors by measuring their angular velocity; and, means to detect the spool having greater angular velocity to have it drive and take up the ribbon from the spool of lesser angular velocity.

2. The system as claimed in claim 1 wherein:

the velocity of the feed motor attached to the feed spool being unwound is determined by counting the number of zero crossings on the back emf waveform in a given period of time.

3. The system as claimed in claim 1 wherein:

the angular velocity of the take-up motor is set by a micro controller in accordance with the angular velocity of the feed motor.

4. The system as claimed in claim 1 wherein:

said feed motor is placed in a regenerative mode with its coils shorted part of the time to provide a variable loading.

5. The system as claimed in claim 4 wherein:

said variable loading is controlled by a micro controller and an interfaced address responsive to the amount of drag required to maintain said ribbon in tension.

6. The system as claimed in claim 1 wherein:

said clean hands portion of said ribbon is an electrically conductive plastic.

7. The system as claimed in claim 6 further comprising:

means to detect the conductive portion of said ribbon in relationship to said print station.

8. The system as claimed in claim 7 further comprising:

means to determine the inked portion of said ribbon with respect to said print station.

9. A system for providing a clean hands ribbon to a printer wherein said clean hands ribbon has a portion of said ribbon that has not been provided with ink comprising:

a line printer having a plurality of spring loaded hammers that are held by a magnetic force which is released by coils overcoming the magnetic force to impact against a print ribbon overlying a sheet of paper on a platen to create a dot matrix formation;

said print ribbon comprising a non-inked clean hands portion having an electrically conductive segment at either end each wound around one of two spools;

motor for driving said spools in a winding take-up direction and a feed direction;

means to determine the angular velocity of at least one of said spools when being driven;

means for detecting the non-inked clean hands portion electrically conductive segment of the ribbon as it passes from one spool to the other; and, means for causing printing by said hammers after the inked ribbon between said clean hands portion is detected.

10. The system as claimed in claim 9 wherein said detection means comprise:

said clean hands ribbon being formed of a conductive plastic; and, means for detecting the placement of said conductive plastic with respect to each spool.

11. The system as claimed in claim 10 further comprising:

said means for detecting the placement of said conductive plastic clean hands ribbon portion comprises at least two conductive surfaces over which said conductive plastic can pass to provide a signal when the two respective surfaces are spanned by said conductive plastic ribbon.

12. The system as claimed in claim 9 further comprising:

determining the placement of an amount of print ribbon on a spool by the relative angular velocity with respect to the other spool.

13. The system as claimed in claim 12 wherein:

one of said spools is driven by a motor for the winding mode and the other of said spools is driven in a regenerative mode to provide a load by means of the coils of said motor being shorted in a variable manner.

14. The system as claimed in claim 13 further comprising:

a zero crossing detector for detecting the zero crossings of the motor operating in a regenerative mode; and, means for counting said zero crossings to provide a respective number of counts to a micro controller for controlling the speed of the print ribbon by the take-up spool.

15. The system as claimed in claim 14 wherein:

the counting of said zero crossings provides the angular velocity of said spools.

16. The system as claimed in claim 15 further comprising:

means for reversing the direction of the print ribbon when detecting the movement of the inked ribbon across the detection means changing from said inked ribbon to said conductive plastic clean hands portion.

17. A combination print ribbon having a non-inked portion and an inked portion in combination with a printer adapted thereto comprising:

a paper drive means for driving a continuous length of paper;

platen means for supporting said paper;

a plurality of striking means;

a print ribbon having a non-inked portion at either end with an inked portion therebetween for printing on the paper;

a pair of spools around which said print ribbon is wound having the non-inked portion initially wound on each spool;

drive motors connected to each of said spools;

electrical output signal means to detect the non-inked portion of said print ribbon; and, means to determine the angular velocity of at least one of said spools so that the spool having less ribbon can be driven as a take-up spool.

18. The combination as claimed in claim 17 wherein:

the motor connected to the spool in the feed mode is controlled as to drag that it provides said print ribbon by shorting the coils thereof.

19. The combination as claimed in claim 17 further comprising:

said electrical output signal means comprising an optical sensor to determine the optical characteristics of said non-inked portion of said print ribbon.

20. The combination as claimed in claim 17 further comprising:

sensors to determine the electrically conductive characterization of said non-inked portion comprising a pair of electrical contacts which can be bridged by an electrically conductive portion of said non-inked portion of said ribbon.

21. A method of providing a clean ribbon portion of a print ribbon to a printer with a print station having a printer engine controller and utilizing an inked portion for printing comprising:

providing a print ribbon wound on a pair of spools having an electrically conductive non-inked portion wound on either spool;

opening the platen of said printer;

providing two electrical contacts on either side of the print station;

checking electrical contact as to the conductive ribbon being in contact with said electrical contacts;

driving said print ribbon and determining the zero crossings of a drive motor connected to the spools to determine the angular velocity of each spool; and, driving the spool with the higher angular velocity as a take-up spool.

22. The method as claimed in claim 21 further comprising:

opening the platen by the engine controller before driving said print ribbon; and, checking the electrical contacts before closing the platen of said printer.

23. The method as claimed in claim 22 further comprising:

checking both contacts as to contact with the electrically conductive portion of said print ribbon before closing the platen of said printer.

24. The method as claimed in claim 23 further comprising:

providing said contacts as a pair of contactors which can be bridged by the conductive portion of said ribbon.

25. A method of using a print ribbon having a non-inked portion wound around each of two spools wherein one of said spools is substantially wound with inked ribbon and the other of said spools is only wound with a non-inked portion and said non-inked portion extends therefrom around the inked portion so as to avoid exposure to a user's hands, said method comprising:

providing a printer with a drive motor for driving each of said spools;

emplacing said spools in driving relationship with each of said motors whereby said non-inked portion is extended between one of said spools to the other of said spools having the inked ribbon portion;

driving at least one of said spools to determine the angular velocity thereof to determine the respective spool having the inked portion thereon to be used as a feed spool while the other is a take-up spool; and, sensing said non-inked portion and providing an electrical output signal to ascertain when printing can begin.

26. Amended The method as claimed in claim 25 further comprising:

providing an engine controller which opens the platen adjacent a print station in which said ribbon is placed;

providing said non-inked ribbon portion as a conductive plastic which can be electrically sensed;

providing electrical contactors on either side of said print station to provide an electrical output signal;

checking an electrical output signal from said contactors to determine the placement of said ribbon;

determining the angular velocity of at least one of said spools when said ribbon is being driven for determining the amounts of ribbon on each of said spools; and, driving one of said spools as a take-up spool and the other of said spools as a feed spool.

27. The method as claimed in claim 26 further comprising:

tensioning said ribbon;

checking the contactors contact with said non-inked ribbon portion;

driving said ribbon in opposite directions to determine the zero crossings of the motors and as to their relative angular velocity; and, comparing said angular velocity through a processor to determine the spool of greater and lesser ribbon content and driving the spool of lesser content as a take-up spool and the spool of greater ribbon content as a feed spool.

* * * * *